US008671881B2

(12) United States Patent
Cheng et al.

(10) Patent No.: US 8,671,881 B2
(45) Date of Patent: Mar. 18, 2014

(54) THICKNESS ADJUSTMENT DEVICE FOR THIN-FILM COATING

(75) Inventors: Jung-Wei Cheng, Taipei (TW); Chang-Pen Chen, Kaohsiung (TW); Jeng-Rong Ho, Taipei (TW); Bo-Ying Li, New Taipei (TW); Yeh-Min Lin, Kaohsiung (TW)

(73) Assignees: Metal Industries Research & Development Centre, Kaohsiung (TW); National Chung Cheng University, Chiayi County (TW)

( * ) Notice: Subject to any disclaimer, the term of this patent is extended or adjusted under 35 U.S.C. 154(b) by 24 days.

(21) Appl. No.: 13/341,068

(22) Filed: Dec. 30, 2011

(65) Prior Publication Data

US 2013/0032086 A1 Feb. 7, 2013

(30) Foreign Application Priority Data

Aug. 3, 2011 (TW) ..... 100127496 A

(51) Int. Cl.
*B05C 3/02* (2006.01)
*B05C 11/00* (2006.01)

(52) U.S. Cl.
USPC ..... 118/712; 118/410; 118/414; 118/261

(58) Field of Classification Search
USPC ..... 118/712, 259, 261, 304, 410, 414, 419, 118/420, 325; 427/355, 356
See application file for complete search history.

(56) References Cited

U.S. PATENT DOCUMENTS

| | | | | |
|---|---|---|---|---|
| 3,418,970 | A * | 12/1968 | Coghill et al. | 118/410 |
| 5,902,400 | A | 5/1999 | Zimmer | |
| 6,432,201 | B1 | 8/2002 | Klas et al. | |
| 7,748,971 | B2 | 7/2010 | Höchsmann et al. | |
| 2001/0008119 | A1 * | 7/2001 | Wight | 118/410 |
| 2004/0170765 | A1 | 9/2004 | Ederer et al. | |

FOREIGN PATENT DOCUMENTS

| | | | |
|---|---|---|---|
| DE | 29517098 | U1 | 2/1997 |
| DE | 10117875 | C1 | 1/2003 |
| DE | 10216013 | B4 | 12/2006 |
| WO | 99/50501 | A1 | 10/1999 |

* cited by examiner

*Primary Examiner* — Yewebder Tadesse
(74) *Attorney, Agent, or Firm* — Rosenberg, Klein & Lee

(57) ABSTRACT

A thickness adjustment device for thin-film coating is revealed. The thickness adjustment device for thin-film coating includes a coating device, a support set, and a thickness adjustment unit. The coating device consists of a work piece conveyor that delivers a work piece, and a material supply unit that carries a coating material onto a surface of the work piece to form a film. The support set is connected to the coating device while the thickness adjustment unit is inserted through and mounted on the support set. The thickness adjustment unit includes a scrape part disposed correspondingly to the work piece and used for applying coating material to form the film. The thickness of the film is adjusted according to a controlling force or torque of the thickness adjustment unit that presses downward. Thus the film is coated on the work piece evenly and the film coating quality is increased.

10 Claims, 14 Drawing Sheets

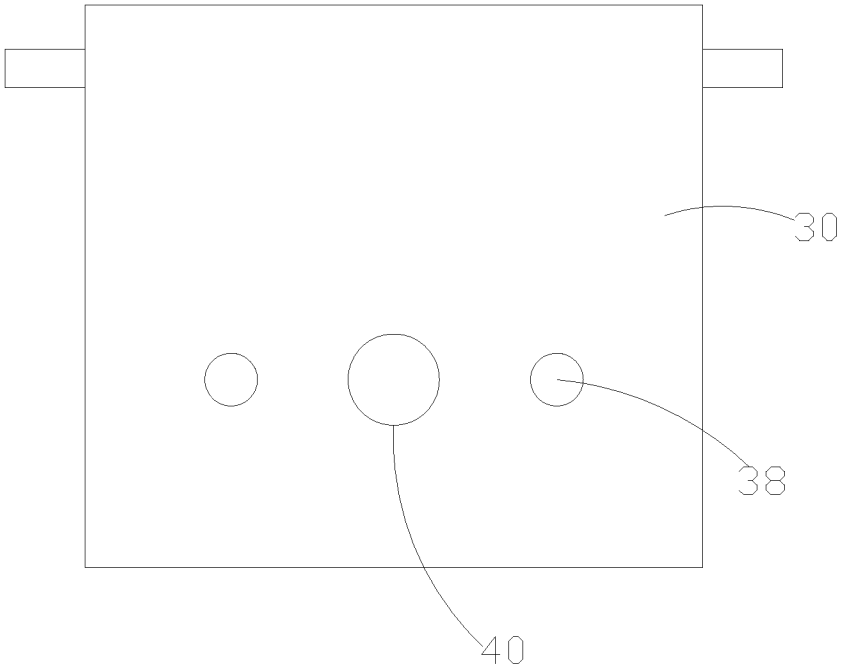
FIG.4A
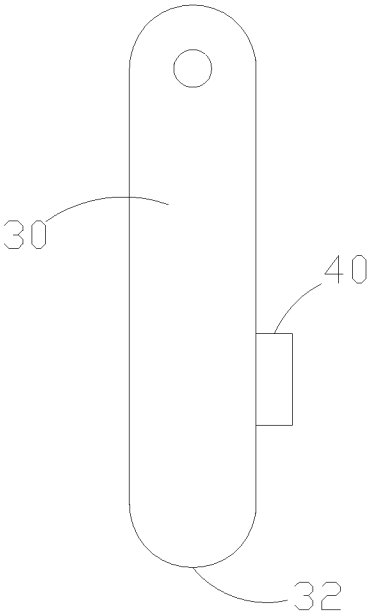

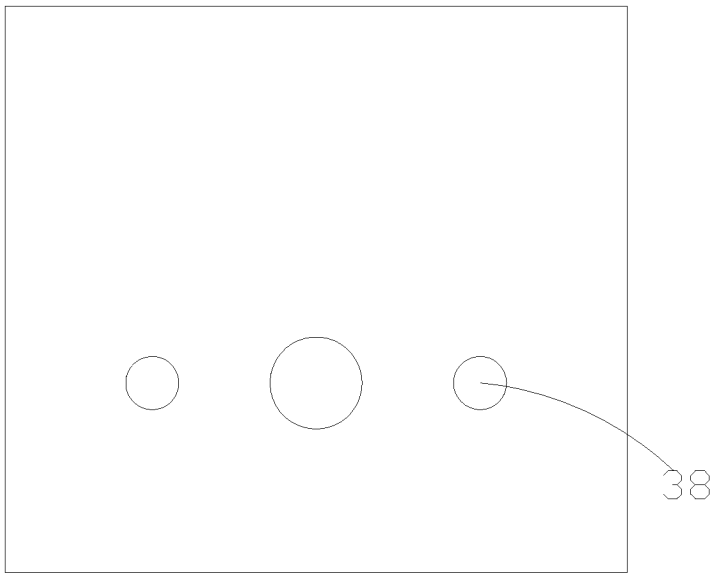
FIG.9A
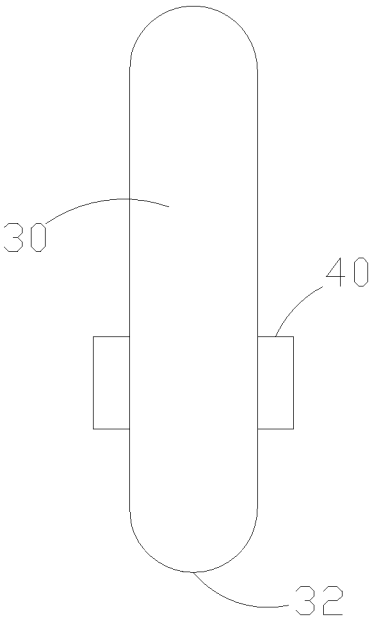

THICKNESS ADJUSTMENT DEVICE FOR THIN-FILM COATING

BACKGROUND OF THE INVENTION

1. Field of the Invention

The present invention relates to a thickness adjustment device for thin-film coating, especially to a thickness adjustment device for thin-film coating that coats materials to form uniform thin films and controls the thickness of the coated films.

2. Descriptions of Related Art

Along with the development of modern technology, a plurality of electronic products have been invented and introduced in the market. Most of these electronics include components produced by coating methods. A single or a composite coating material is coated on a substrate or a surface of the substrate. In conventional coating technologies, the surface of the substrate is coated with a selected coating material by manually operated brush coating or scrape coating. Thus the coating is uneven, the coated film is with different thickness, or a part of the surface is uncoated. In some application fields which require higher coating quality or use special coating materials, manual operation is not feasible so that coating mechanisms are used to increase production efficiency.

A conventional coating mechanism used in film industry, tape industry, printed circuit board (PCB) industry is roller coating. In roller coating, a roller of an upper film and a roller of a lower film respectively are in rolling contact with a coating roller. The coating roller is fixed or is pressed by roller shafts on two sides for film coating. However, during coating and film lamination of the coating roller, the film produced is thick and uneven. Thus the coating quality is poor, the defective rate is high, and the manufacturing cost is increased.

For example, while manufacturing fuel cells, catalyst materials are coated on surfaces of carbon substrate. The power conversion efficiency of the fuel cell will be adversely affected if the coating is not even. Moreover, if users want to adjust the thickness of the film to be coated, the distance between rollers needs to be adjusted. For getting different film thickness, rollers are adjusted frequently. This causes inconvenience for film coating.

During the manufacturing process of liquid crystal display, a surface of liquid crystal display is coated with a protective film for preventing scratches caused by abrasion or impacts. Before attaching the protective film to the surface of the liquid crystal display, an adhesive film is coated on the surface of the liquid crystal display to facilitate attachment of the protective film. If the adhesive film is not coated evenly, the protective film is unable to be attached closely, giving rise to distortions or wrinkles easily. The manual coating tends to lead to uneven coating and varying thickness of the adhesive film. Some parts of the surface are even uncoated. Without close attachment, the protective film is easy to peel or come off.

In addition, the thickness of the film coated by conventional coating mechanisms is at the millimeter (mm) scale or micron-meter (μm) scale. The thickness of the coated film is unable to be controlled in the nanometer scale.

Thus there is a room for improvement and a need to provide a thickness adjustment device for thin-film coating that coats materials on work pieces evenly and controls the thickness of the coated films. The thickness of the coated films is controlled at the nanometer (nm) scale so as to solve the above problems.

SUMMARY OF THE INVENTION

Therefore it is a primary object of the present invention to provide a thickness adjustment device for thin-film coating in which a coating device is connected to a support set with a thickness adjustment unit. The thickness adjustment unit includes a scrape part for applying coating material to a work piece and forming a film on the work piece. The thickness of the film can be adjusted according to a torque control or a force control. Thus the film is coated on the work piece evenly and the film coating quality is improved.

It is another object of the present invention to provide a thickness adjustment device for thin-film coating that includes a force control unit, the force control unit can be a balance weight body, an add-on spring, or a motor. By adjusting the weight of the balance weight body, the pre-straining of the add-on spring, or the force exerted by the motor to control a force of the thickness adjustment unit that presses downward. Thus the thickness of the film coated on the work piece can be controlled and the convenience of film coating increased.

It is another object of the present invention to provide a thickness adjustment device for thin-film coating that includes a torque control unit, the torque control unit can be provided by a balance weight body, an add-on spring, or a motor. By adjusting the pre-straining of the add-on spring, or the torque setting of the motor to control a torque of the thickness adjustment unit that presses downward. Thus the thickness of the film coated on the work piece can be controlled and the convenience of film coating increased.

The thickness adjustment device for thin-film coating of the present invention consists of a coating device, a support set, and a thickness adjustment unit. The coating device is composed of at least one work piece conveyor that delivers a work piece and at least one material supply unit that carries a coating material onto a surface of the work piece to form a film. The support set is connected to the coating device while the thickness adjustment unit is penetrated through and arranged at the support set. The thickness adjustment unit includes a scrape part disposed relative to the work piece and used for applying coating material to form the film. The thickness of the film is adjusted according to controlling a force or a torque of the thickness adjustment unit that presses downward. Thus the film is coated on the work piece evenly and the film coating quality is improved. Moreover, the thickness of the film can be controlled at the nanometer (nm) scale.

The thickness adjustment unit in the present invention can further include a force control unit or a torque control unit, so that the thickness of the film coated can be adjusted and coated evenly.

And also, the thickness adjustment device of the present invention can combine with a film thickness detector (such as a white light interferometers or an electromagnetic coating thickness detector) to adjust force control or torque control on-line automatically for reaching the object of precision thin-film coating. The thickness adjustment unit of the present invention can combine with the coating device which employs one or more rollers for thin-film coating; by using the roller coating continuously, the object of coating in large area can be achieved. The thickness adjustment unit of the present invention can also combine with a roll-to-roll conveyor with work piece unwound at one end and wound at the other end continuously; by directly applying the coating material onto this type of roll-to-roll work piece, the object of coating in large area can be achieved.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein:

FIG. 4A is a schematic drawing showing structure of a coating device of another embodiment according to the present invention;

FIG. 9A is a schematic drawing showing structure of a coating device of a further embodiment according to the present invention;

DETAILED DESCRIPTION OF THE PREFERRED EMBODIMENT

Figure 1:
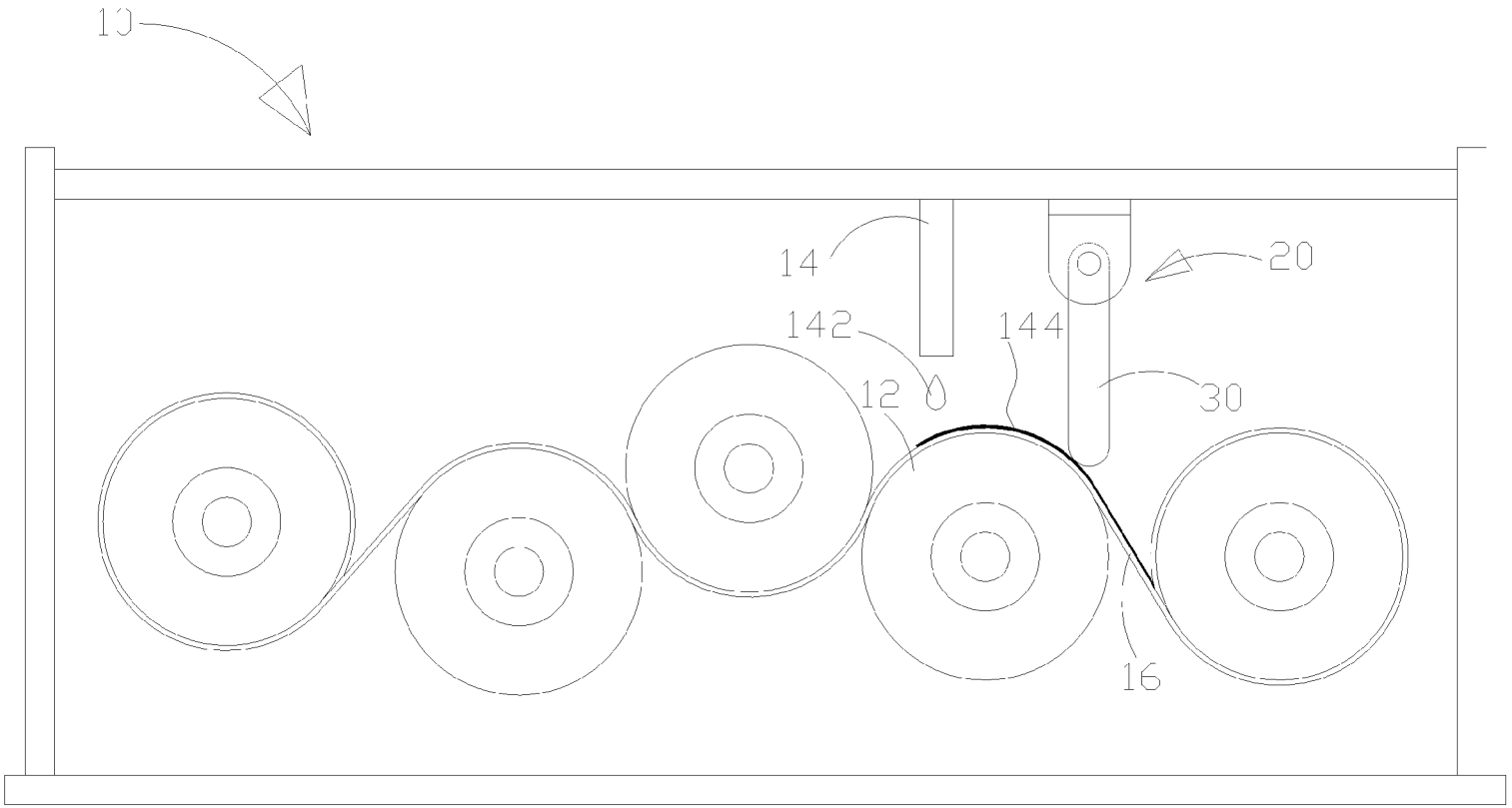
FIG. 1 is a schematic drawing showing a thickness adjustment device for thin-film coating of an embodiment according to the present invention.

Refer to FIG. 1, the first embodiment disclosed a thickness adjustment device for thin-film coating includes a coating device 10, a support set 20, and a thickness adjustment unit 30. The coating device 10 consists of a work piece conveyor 12 and a material supply unit 14. The work piece conveyor 12 is used to deliver a work piece 16 while the material supply unit 14 is located above the work piece 16 and used for providing a coating material 142 on a surface of the work piece 16. The coating material 142 forms a film 144 on the surface of the work piece 16. The support set 20 is connected to the coating device 10 and arranged above the work piece conveyor 12 and on one side of the material supply unit 14, but not limited to this position. One end of the thickness adjustment unit 30 is penetrated through the support set 20 and located on one side of the material supply unit 14. The thickness adjustment unit 30 is arranged in relation to the work piece conveyor 12. The work piece 16 is set between the work piece conveyor 12 and the thickness adjustment unit 30. The present invention uses the thickness adjustment unit 30 to apply the coating material 142 on the work piece 16 to form the film 144. The thickness adjustment unit 30 controls thickness and evenness of the film 144, allowing the film 144 evenly coated on the work piece 16, so as to improve coating quality of the film 144. In this embodiment, the work piece conveyor 12 is composed of at least one roller. The work piece 16 is, but not limited to, a flexible work piece 16. The thickness adjustment unit 30 is penetrated through and disposed on the support set 20 around an axis that is used as a center of rotation. The thickness adjustment unit 30 of the present invention can combine with the coating device 10 which employs one or more rollers for thin-film coating; by using the roller coating continuously, the object of coating in large area can be achieved. The thickness adjustment unit of the present invention can also combine with a roll-to-roll conveyor with work piece unwound at one end and wound at the other end continuously; by directly applying the coating material onto the this type of roll-to-roll work piece, the object of coating in large area can be achieved.

Figure 2A:
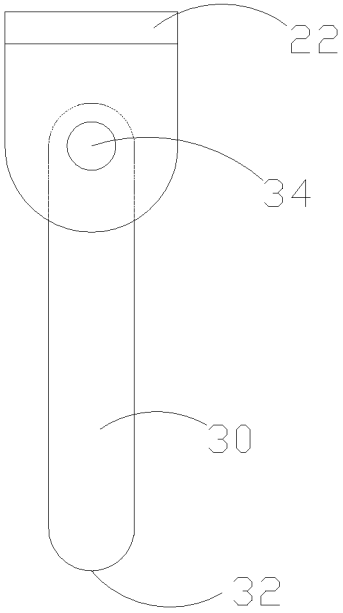
FIG. 2A is a front view of an assembly of a support set and a thickness adjustment unit of the embodiment in FIG. 1 according to the present invention.
Figure 2B:
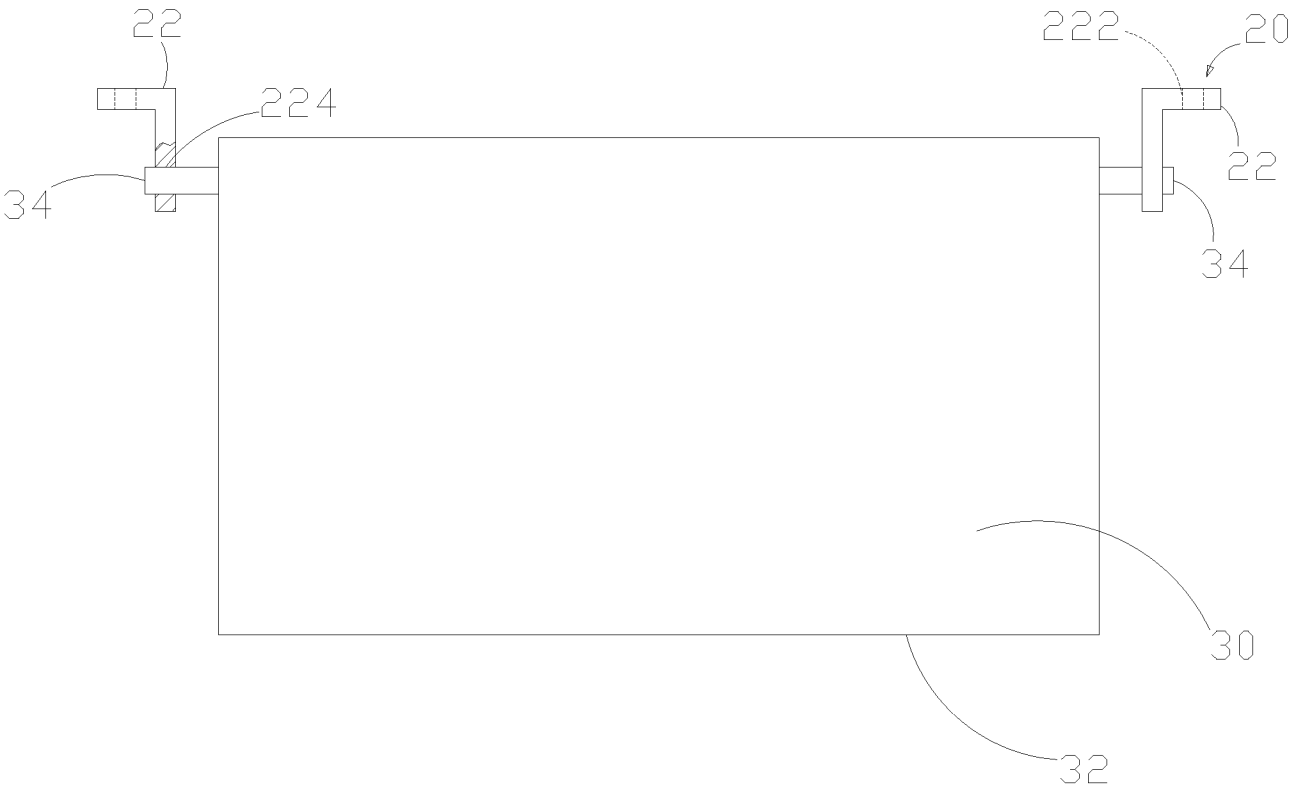
FIG. 2B is a side view of an assembly of a support set and a thickness adjustment unit of the embodiment in FIG. 1 according to the present invention.

Refer to FIG. 2A and FIG. 2B, a front view and a side view of an assembly of the support set 20 and the thickness adjustment unit 30 are revealed. As shown in the figures, the support set 20 includes two pivot bases 22 each of which having a fastening part 222 and a first pivot part 224. The pivot base 22 of the support set 20 is connected to the coating device 10 by the fastening part 222. The support set 20 is pivotally connected with the thickness adjustment unit 30 by the two first pivot parts 224. The first pivot part is in the form of a shaft or in the form of a hole.

A scrape part 32 is disposed on one end of the thickness adjustment unit 30 and a second pivot part 34 is arranged at the other end of the thickness adjustment unit 30. The scrape part 32 is set relative to the work piece 16 and is for applying the coating material 142 to the work piece 16 so as to form the film 144. The two pivot parts 34 of the thickness adjustment unit 30 are respectively connected to the first pivot part 224 of each pivot base 22. Thus the thickness adjustment unit 30 can rotate and swing in relation to the two pivot bases 22. The second pivot part 34 can be in the form of a shaft or in the form of a shaft that is pivotally connected to the first pivot part 224. In practice, a bearing unit is set between the first pivot part 224 and the second pivot part 34 so as to reduce friction therebetween.

In this embodiment, the thickness adjustment unit 30 is a rectangular column or a plate and the scrape part 32 is at a lower end of the column/plate. In a preferred embodiment, the scrape part 32 includes a curved edge. The two second pivot parts 34 are on an upper end of the column/plate and are respectively disposed on two ends of the column/plate. If each first pivot part 224 of the pivot base 22 is an insertion hole, each second pivot part 34 of the thickness adjustment unit 30 is a shaft. By the two shafts pivotally connected to the insertion hole of each pivot base 22, the thickness adjustment unit 30 rotate around a central axis of the first pivot parts 224 (insertion holes) of the pivot bases 22.

Figure 3:
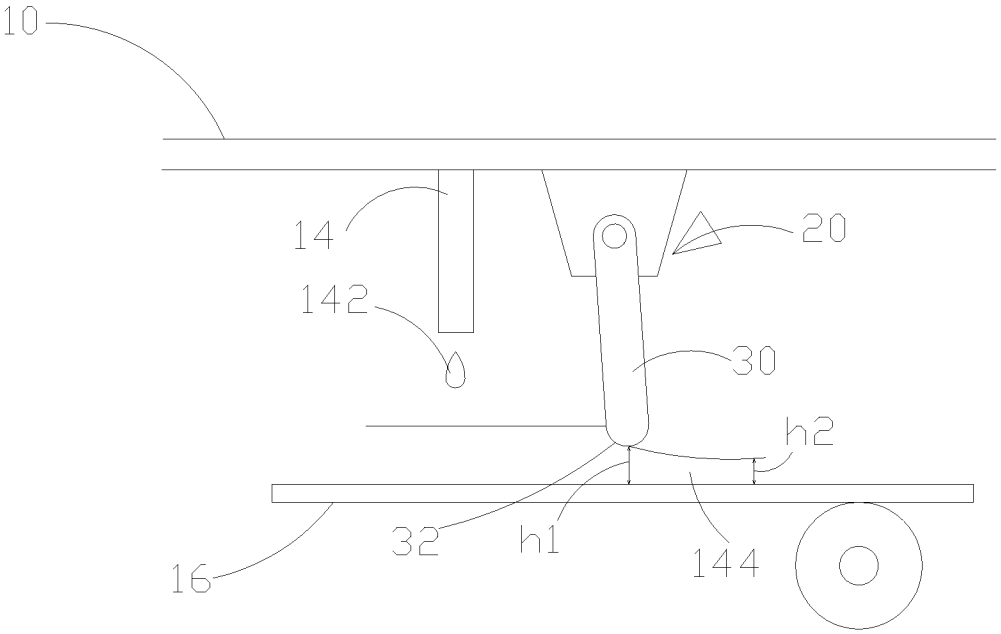
FIG. 3 is a schematic drawing showing a thickness adjustment unit in using state of the embodiment in FIG. 1 according to the present invention.

Refer to FIG. 3, a thickness adjustment unit of the first embodiment in use is revealed. While applying the coating material, the thickness adjustment unit 30 is in contact with the surface of the work piece 16 and then the material supply unit 14 carries the coating material 142 to the surface of the work piece 16. At the same time, the work piece conveyor 12 moves the work piece 16. When the scrape part 32 of the thickness adjustment unit 30 contacts with the coating material 142, the coating material 142 on the work piece 16 applies a force to the thickness adjustment unit 30 and a first torque around an axis of the first pivot part 224 of the pivot base 22 (the center of rotation of the thickness adjustment unit 30). The first torque makes the thickness adjustment unit 30 rotate and swing (in the counterclockwise direction shown in FIG. 3). Thus the thickness adjustment unit 30 is away from and not in contact with the work piece 16 due to the swing. After the rotation, a center of gravity of the thickness adjustment unit 30 is off the axis of the pivot base 22 so that the weight of the thickness adjustment unit 30 generates a second torque around the axis of the pivot base 22. When the second torque is balanced with the first torque, the thickness h1 of the coating material 142 away from the scrape part 32 is determined and the thickness h2 of the film 144 is also determined. Therefore, the film adjustment is achieved. Users can also get the thickness of the coated film required by adjusting various parameters such as the amount of the coating material 142 added, the weight of the thickness adjustment unit 30, the center of gravity of the thickness adjustment unit 30, the moving speed of the work piece 16, viscosity coefficient of the coating material 142, etc.

Refer to FIG. 4A, the second embodiment of the present invention is revealed. The difference between this embodiment and the above one is in that this embodiment further includes a torque control unit, wherein the torque control unit is a balance weight body 40. One side of the thickness adjustment unit 30 is disposed with a counter weight part 38. In this embodiment, the counter weight part 38 is arranged at the side from which the coating material 142 is provided. As shown in the FIG. 4A, the counter weight part 38 is arranged at the right side of the thickness adjustment unit 30. The balance weight body 40 is set on the counter weight part 38. The heavier the balance weight body 40, the larger the torque of the thickness adjustment unit 30 that presses downward.

Figure 4B:
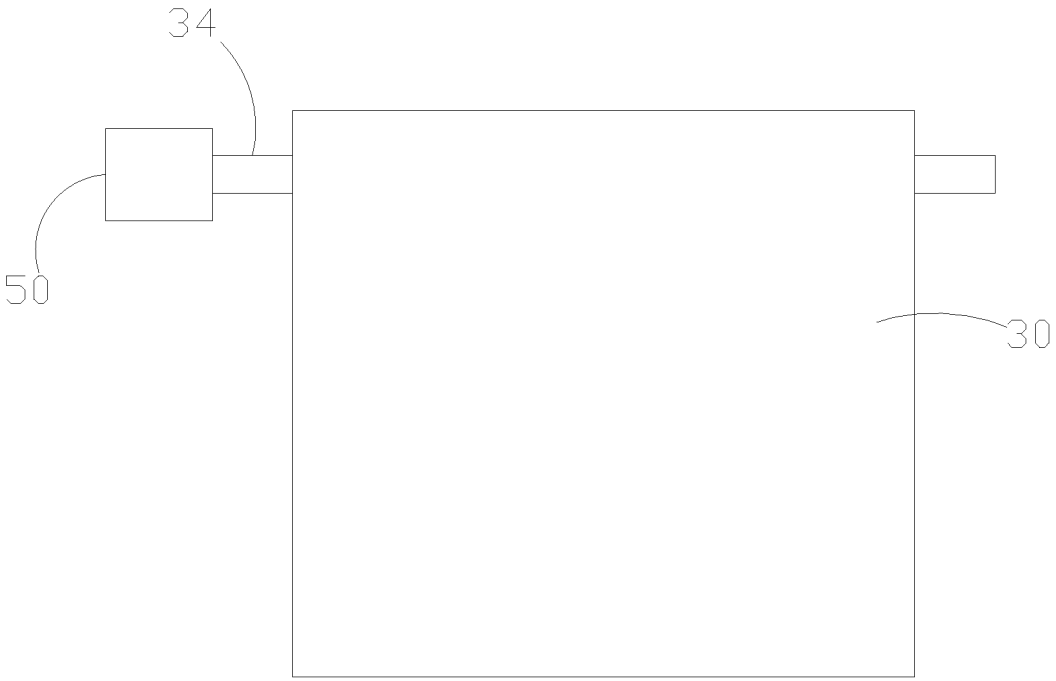
FIG. 4B is a schematic drawing showing structure of a coating device of a further embodiment according to the present invention.

Refer to FIG. 4B, the torque control unit 50 can be an add-on spring or a motor. The torque control unit 50 is disposed in the pivot part 34 of the thickness adjustment unit 30 for adjust the torque of pressing downward through the torque control unit 50.

In other words, the thickness adjustment in thin-film coating is controlled by the torque control unit 50, by adjusting the weight of the balance weight body 40, the pre-straining of the add-on spring, or the torque setting of the motor, so that the pressing torque of the thickness adjustment unit 30 can be controlled. Therefore the thickness of the coating material 142 coated on the work piece 16 can be controlled and the convenience of coating the film 144 is improved.

Then, the thickness adjustment unit 30 in this embodiment can further include the torque control unit 50, so that the thickness of the film coated can be adjusted and coated evenly. And also, the thickness adjustment device in this embodiment further includes a film thickness detector (such as a white light interferometers or an electromagnetic coating thickness detector) to adjust torque control on-line automatically for reaching the object of precision thin-film coating.

Figure 5:
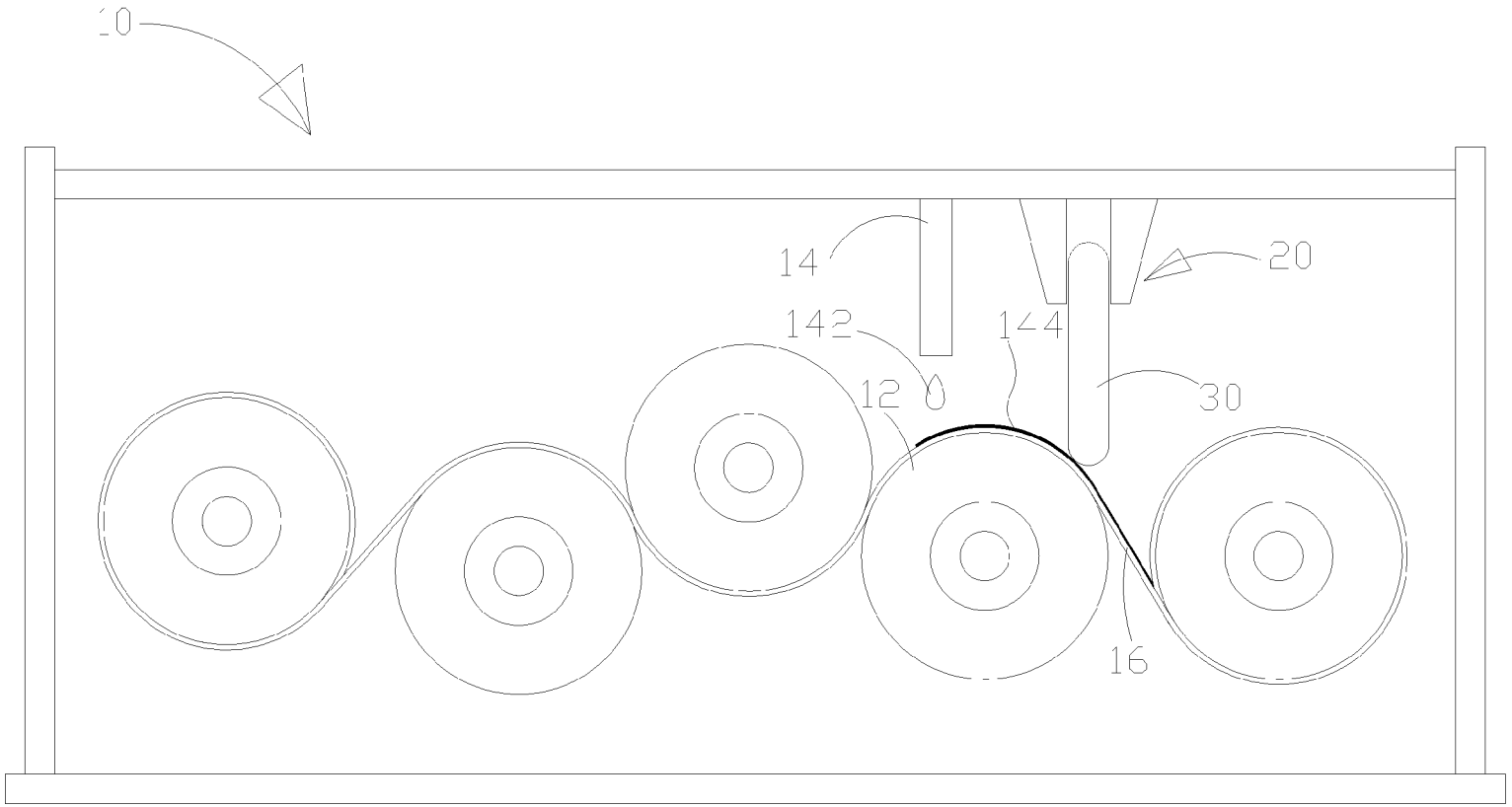
FIG. 5 is a schematic drawing showing a thickness adjustment device for thin-film coating of a further embodiment according to the present invention.

Refer to FIG. 5, the third embodiment is disclosed. As shown in the figure, a thickness adjustment device for thin-film coating includes a coating device 10, a support set 20, and a thickness adjustment unit 30. The coating device 10 of this embodiment is the same with the first embodiment and the connection among the coating device 10, the support set 20, and the thickness adjustment unit 30 is also the same with the first embodiment.

Figure 6:
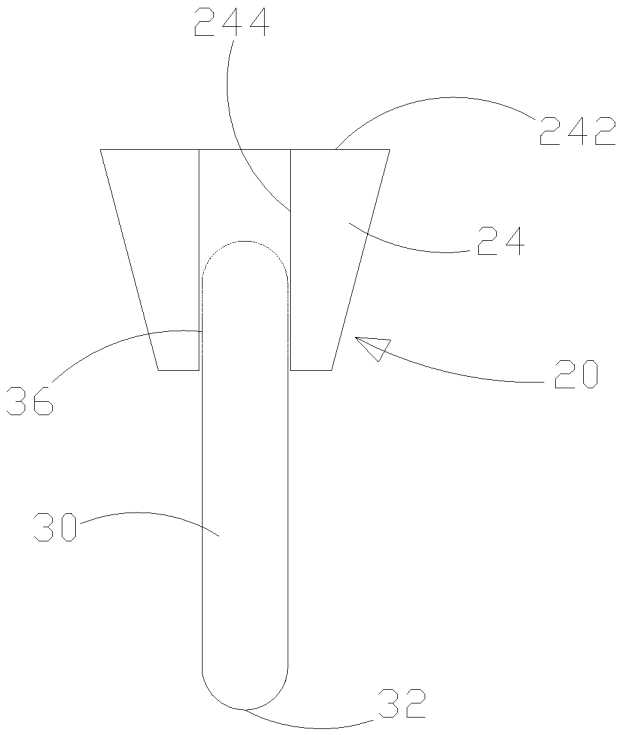
FIG. 6 is a front view of an assembly of a support set and a thickness adjustment unit of the embodiment in FIG. 5 according to the present invention.

Refer to FIG. 6, it is a front view of an assembly of a support set and a thickness adjustment unit of the third embodiment according to the present invention. In this embodiment, the support set 20 consists of at least one sliding contact base 24 that is formed by a fastening part 242 and a first sliding contact part 244. The support set 20 (the sliding contact base 24) is connected to the coating device 10 by the fastening part 242. Moreover, the support set 20 is in sliding contact with and guiding the thickness adjustment unit 30 by the first sliding contact part 244. The first sliding contact part 244 can be in the form of a guiding slot or a sliding block.

One end of the thickness adjustment unit 30 is arranged with a scrape part 32 while the other end thereof is disposed with a second sliding contact part 36. The scrape part 32 is disposed corresponding to the work piece 16 and is used to applying the coating material 142 to the work piece 16 so as to form the film 144. The second sliding contact part 36 of the thickness adjustment unit 30 is connected to the first sliding contact part 244 of the sliding contact base 24 so that the thickness adjustment unit 30 can move and slide in relation to the sliding contact base 24. The second sliding contact part 36 can be in the form of a sliding block or in the form of a guiding slot that is in sliding contact with the first sliding contact part 244. In practice, a bearing unit is set between the first sliding contact part 244 and the second sliding contact part 36 so as to reduce friction therebetween.

In this embodiment, the thickness adjustment unit 30 is a rectangular column or a plate and the scrape part 32 is at a lower end of the column/plate. In a preferred embodiment, the scrape part 32 includes a curved edge. The second sliding contact part 36 is located on an upper end of the column/plate. The first sliding contact part 244 of the sliding contact base 24 is a guiding slot and the second sliding contact part 36 of the thickness adjustment unit 30 is a sliding block. By the sliding block mounted into the guiding slot of the sliding contact base 24, the thickness adjustment unit 30 is moved linearly under the guidance of the first sliding contact part 244 (guiding slot) of the sliding contact base 24.

Figure 7:
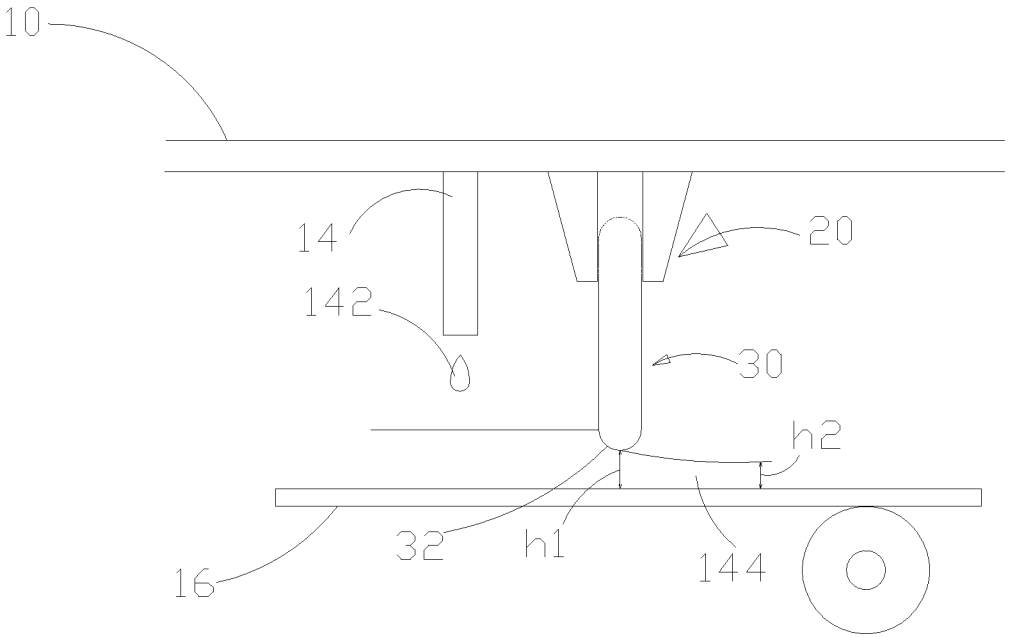
FIG. 7 is a schematic drawing showing a thickness adjustment unit practicing the embodiment in FIG. 5 according to the present invention.

Refer to FIG. 7, a thickness adjustment unit of the third embodiment in use is revealed. While applying the coating material, the thickness adjustment unit 30 contacts the surface of the work piece 16 and then the material supply unit 14 gets the coating material 142 to the surface of the work piece 16. The work piece conveyor 12 moves the work piece 16 simultaneously. Once the scrape part 32 of the thickness adjustment unit 30 contacts the coating material 142, the coating material 142 on the work piece 16 applies a force to the thickness adjustment unit 30. The component of the force along the first sliding contact part 244 of the sliding contact base 24 makes the thickness adjustment unit 30 move toward the first sliding contact part 244 linearly (move upward linearly in the FIG. 7). Thus the thickness adjustment unit 30 is away from the surface of the work piece 16, without contact to the work piece 16. Moreover, the thickness adjustment unit 30 has a downward force (weight) due to gravity. When the component of the weight of the thickness adjustment unit 30 in the direction of the first sliding contact part 244 is balanced with the component of the force in the direction of the first sliding contact part 244, the thickness h1 of the coating material 142 away from the scrape part 32 is determined and the thickness h2 of the film 144 is also determined. Thus the film adjustment is achieved. Users can also get the thickness of the coated film required by adjusting various parameters such as the amount of the coating material 142 added, the weight of the thickness adjustment unit 30, the moving speed of the work piece 16, viscosity coefficient of the coating material 142, etc.

Figure 8:
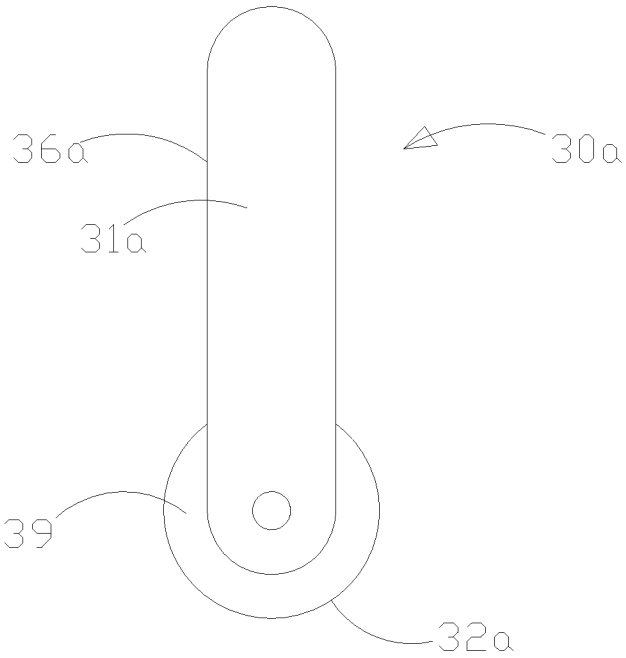
FIG. 8 is a schematic drawing showing another mode of a thickness adjustment unit of the embodiment in FIG. 5 according to the present invention.

Refer to FIG. 8, another mode of a thickness adjustment unit of the third embodiment is revealed. A thickness adjustment unit 30*a* of this mode includes a cylinder (or a plate) 31*a* and a roller 39. One end of the cylinder/plate 31*a* is a second sliding contact part 36*a* that is in sliding contact with a support set 20 while the other end of the cylinder/plate 31*a* is pivotally connected with the roller 39. The circumference of the roller 39 forms a scrape part 32*a*.

Refer to FIG. 9A, a coating device of a further embodiment of the present invention is revealed. The difference between this, the fourth embodiment and the above one is in that this embodiment further includes a force control unit, wherein the force control unit is a balance weight body 40. A side wall of the thickness adjustment unit 30 is arranged with a counter weight part 38. The balance weight body 40 is disposed on the counter weight part 38. The heavier the balance weight body 40, the larger the force of the thickness adjustment unit 30 that presses downward.

Figure 9B:
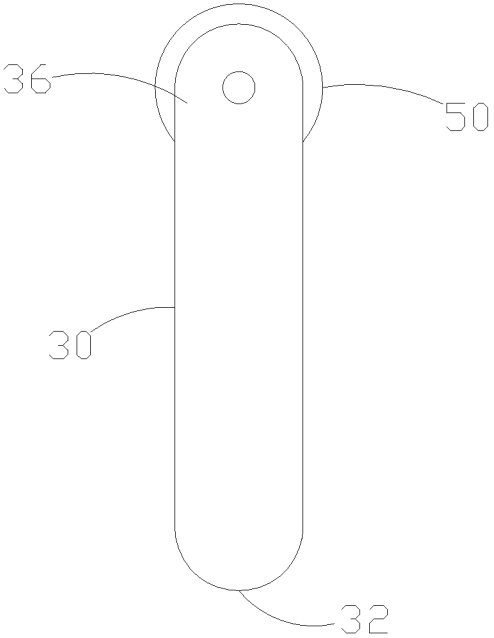
FIG. 9B is a schematic drawing showing structure of a coating device of a further embodiment according to the present invention.

Refer to FIG. 9B, the force control unit 50 can be an add-on spring, or a motor. The force control unit 50 is disposed in the second sliding contact part 36 of the thickness adjustment unit 30 for adjusting the force of pressing downward through the force control unit.

In other words, the thickness adjustment in thin-film coating is controlled by the force control unit, by adjusting the weight of the balance weight body, the pre-straining of the add-on spring, or the force setting of the motor, so that the pressing force of the thickness adjustment unit 30 can be controlled. Therefore the thickness of the coating material 142 coated on the work piece 16 can be controlled and the convenience in the process of coating the film 144 is improved.

Then, the thickness adjustment unit 30 in this embodiment can further include the force control unit, so that the thickness of the film coated can be adjusted and coated evenly. And also, the thickness adjustment device in this embodiment further includes a film thickness detector (such as a white light interferometers or an electromagnetic coating thickness detector) to adjust force control on-line automatically for reaching the object of precision thin-film coating.

Figure 10A:
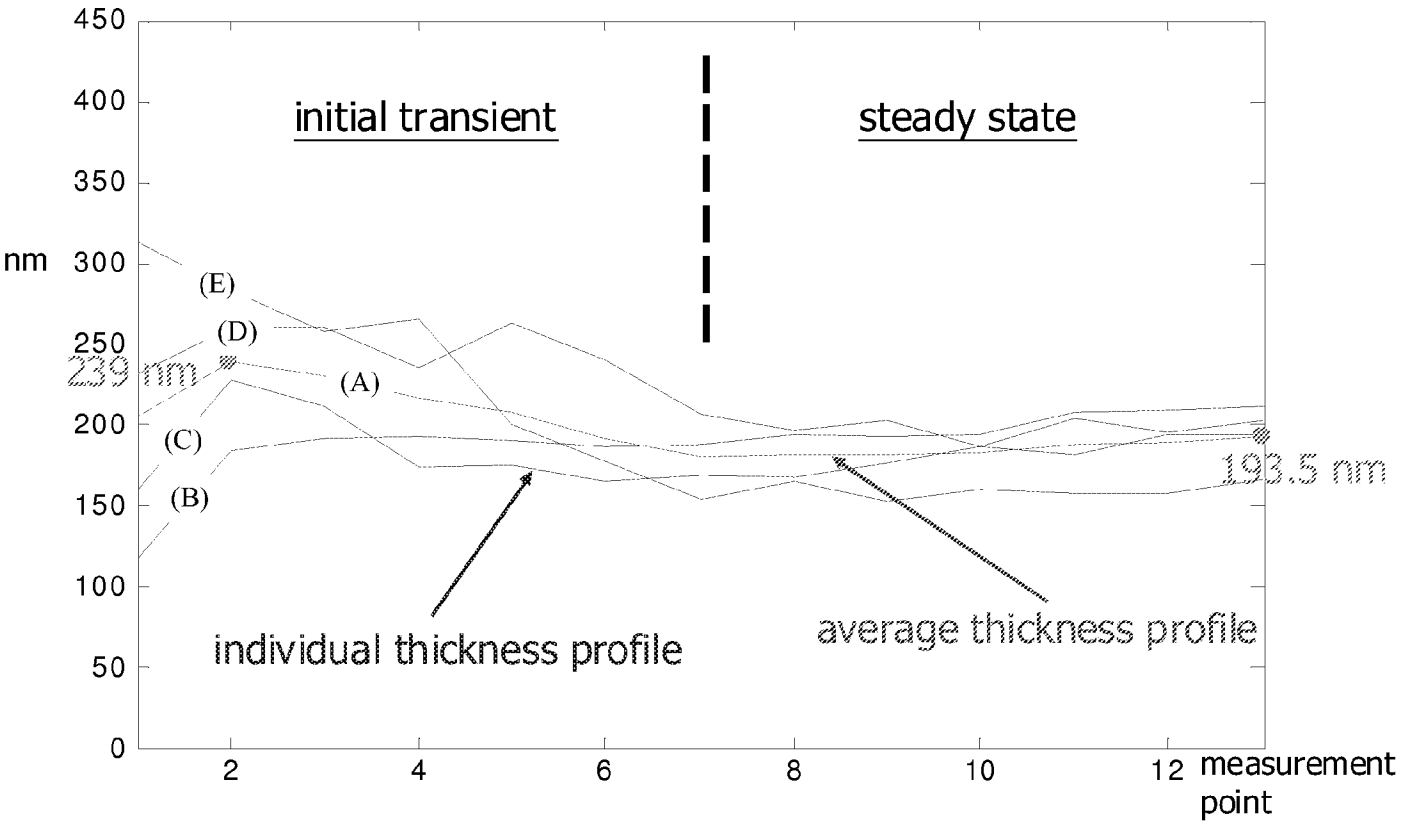
FIG. 10A is a thin-film coating result of the embodiment according to the present invention.
Figure 10B:
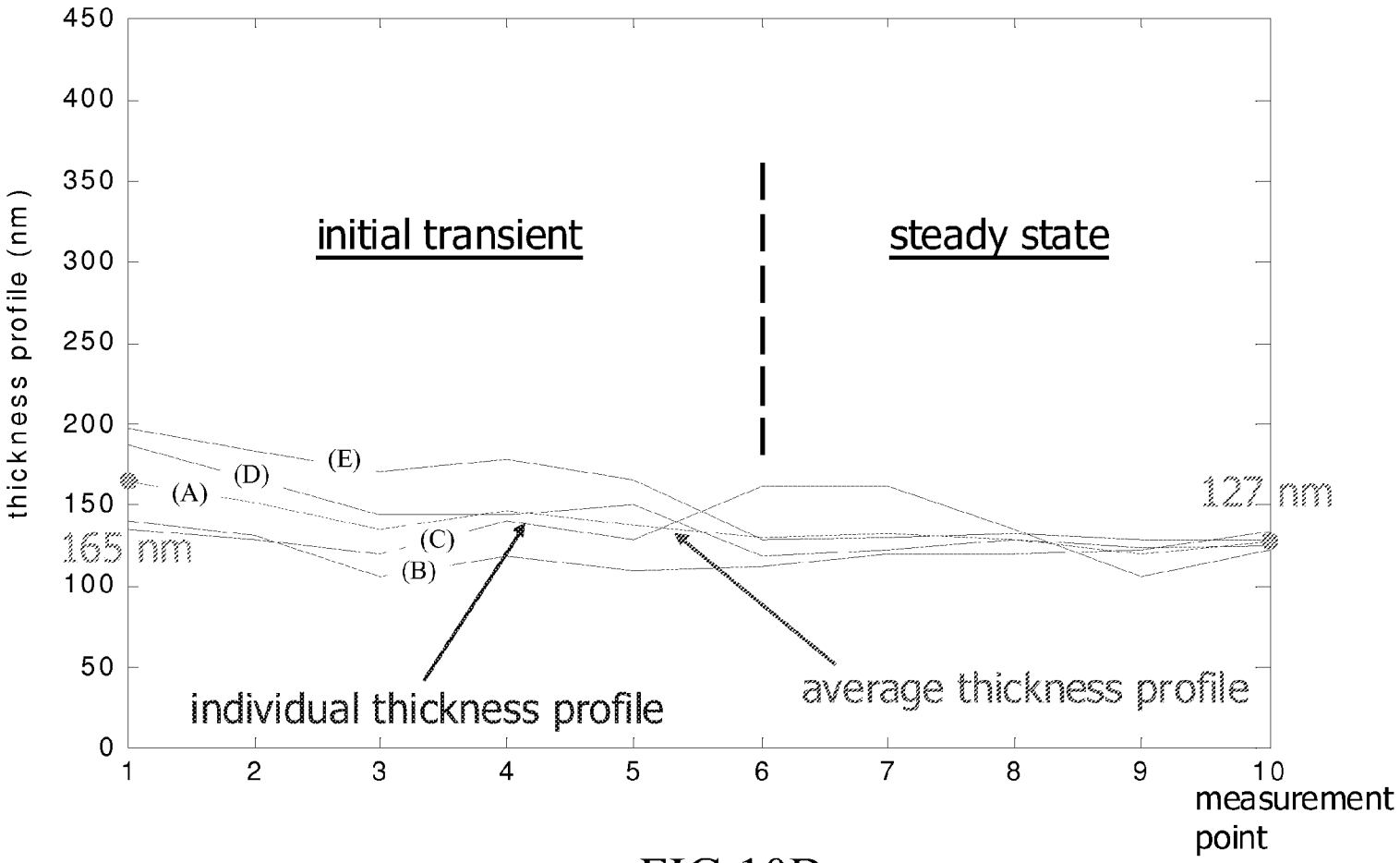
FIG. 10B is a thin-film coating result of the embodiment according to the present invention.

Refer to FIGS. 10A and 10B, two thin-film coating results of the embodiment are revealed. Each thin-film coating result is according to detection of four poly(methyl methacrylate) (PMMA) films coated consecutively by thin film measurement instrument (α-step IQ, Tenco). In FIGS. 10A and 10B, the blue lines refer to the thickness profiles of the coated PMMA thin-films. There are 13 thickness measurement points on each coated film with a 1.5 cm interval between two neighboring measurement points. Line A refers to the average thickness profile of four individual thickness profiles, line B-E. The control parameters are the movement speed of the sample, the weight of the scraper, the concentration of the PMMA solution, and the pneumatic pressure used to control the amount of coating material delivered by the material supply unit. The values of the control parameters in FIG. 10A are 5.72 m/min, 600 g, 7.5 wt %, and 10 psi respectively; in FIG. 10B the parameter values are 5.72 m/min, 600 g, 5 wt %, 8 psi respectively. According to FIG. 10A and FIG. 10B, the average thickness of thin-film coating result and uniformity are 184.8 nm±18.7 nm (10%) and 128 nm±13 nm (10%) respectively, and the average film roughness is 2.7 nm and 2.1 nm respectively. Thus, under proper control parameters, the present invention can control the thickness in a range of 100 nm with the uniformity in a range of ±10% and average film roughness around 2 nm.

In summary, a thickness adjustment device for thin-film coating includes a coating device, a support set, and a thickness adjustment unit. The coating device consists of a work piece conveyor and a material supply unit. The work piece conveyor is for delivering a work piece while the material supply unit gets coating material onto a surface of the work piece to form a film on the work piece. The support set is connected to the coating device and one end of the thickness adjustment unit is penetrated through and mounted in the support set. The thickness adjustment unit includes a scrape part that is set relative to the work piece and is used for applying the coating material to the work piece so as to form the film. The thickness of the film is adjusted according to a torque or a force control unit of the thickness adjustment unit and the film is coated on the work piece evenly. As mentions in the embodiments, the force control unit and the torque control unit can choose from a balance weight body, an add-on spring, and a motor, but not limited to these components. Thus the film coating quality is improved. Moreover, the thickness of the film is determined according to the balance between the torque of the thickness adjustment unit controlled by the torque control unit and the torque applied to the thickness adjustment unit by the coating material on the work piece, or according to the balance between the force of the thickness adjustment unit controlled by the force control unit and the force applied to the thickness adjustment unit by the coating material on the work piece. The structure of the thickness adjustment device of the film is simplified and the cost of the device is reduced.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A thickness adjustment device for thin-film coating comprising:

at least one coating device having a work piece conveyor and a material supply unit; the work piece conveyor delivers at least one work piece, and the material supply unit carries a coating material onto the work piece and the coating material forms a film on the work piece;

at least one support set that is connected to and disposed on the coating device; and at least one thickness adjustment unit penetrated through and arranged at the support set; the thickness adjustment unit having a scrape part that is disposed correspondingly to the work piece and used for applying the coating material to form the film on the work piece, wherein the thickness adjustment unit is a rectangular column or a plate; the scrape part is at a one end of the column or of the plate, the scrape part includes a curved edge, the thickness adjustment unit further includes a roller pivotally connected to one end of the cylinder or the plate; a circumference of the roller forms the scrape part;

wherein the thickness of the film is adjusted according to a controlling force or torque of the thickness adjustment unit that presses downward.

2. The device as claimed in claim 1, wherein the device further includes a torque control unit, the torque control unit controlling a torque of the thickness adjustment unit that presses downward, wherein the torque control unit is a balance weight body, an add-on spring, or a motor.

3. The device as claimed in claim 2, wherein the coating material applies a torque to the thickness adjustment unit while the scrape part and the coating material are contacting each other; the thickness of the film is determined according to the balance between the torque of the thickness adjustment unit controlled by the torque control unit and the torque applied to the thickness adjustment unit by the coating material.

4. The device as claimed in claim 1, wherein the device further includes a force control unit, the force control unit controlling a force of the thickness adjustment unit that presses downward, wherein the force control unit is a balance weight body, an add-on spring, or a motor.

5. The device as claimed in claim 4, wherein the thickness adjustment unit is disposed with a counter weight part and the balance weight body is arranged at the counter weight part.

6. The device as claimed in claim 4, wherein the coating material applies a force to the thickness adjustment unit while the scrape part and the coating material are contacting each other; the thickness of the film is determined according to the balance between the force of the thickness adjustment unit controlled by the force control unit and the force applied to the thickness adjustment unit by the coating material.

7. A thickness adjustment device for thin-film coating comprising:

at least one coating device, having a work piece conveyor and a material supply unit; the work piece conveyor delivers at least one work piece, and the material supply unit carries a coating material onto the work piece and the coating material forms a film on the work piece;

at least one support set, that is connected to and disposed on the coating device; and at least one thickness adjustment unit, penetrated through and arranged at the support set; the thickness adjustment unit having a scrape part that is disposed correspondingly to the work piece and used for applying the coating material to form the film on the work piece;

wherein the thickness of the film is adjusted according to a controlling force or torque of the thickness adjustment unit that presses downward, the support set includes two pivot bases each of which having a fastening part and a first pivot part; each of the two pivot bases is connected to the coating device by the fastening part; the thickness adjustment unit further includes two second pivot parts that are disposed in relation to the scrape part and located on two opposite ends thereof; the two second pivot parts of the thickness adjustment unit are respectively connected to the corresponding first pivot part of each pivot base so that the thickness adjustment unit is able to rotate and swing in relation to the pivot bases.

8. The device as claimed in claim 7, wherein the first pivot part is a hole while the second pivot part is a shaft.

9. A thickness adjustment device for thin-film coating comprising:

at least one coating device, having a work piece conveyor and a material supply unit; the work piece conveyor delivers at least one work piece, and the material supply unit carries a coating material onto the work piece and the coating material forms a film on the work piece;

at least one support set, that is connected to and disposed on the coating device; and at least one thickness adjustment unit, penetrated through and arranged at the support set; the thickness adjustment unit having a scrape part that is disposed correspondingly to the work piece and used for applying the coating material to form the film on the work piece;

wherein the thickness of the film is adjusted according to a controlling force or torque of the thickness adjustment unit that presses downward, the support set includes a sliding contact base having a fastening part and a first sliding contact part; the sliding contact base is connected to the coating device by the fastening part; the thickness adjustment unit further includes a second sliding contact part that is disposed in relation to the scrape part; the second sliding contact part is connected to the first sliding contact part of the sliding contact base so that the thickness adjustment unit is able to move and slide in relation to the sliding contact base.

10. The device as claimed in claim 9, wherein the first sliding contact part is a guiding slot while the second sliding contact part is a sliding block.

* * * * *